United States Patent [19]

Hinds

[11] 4,326,708

[45] Apr. 27, 1982

[54] METHOD FOR USING ELASTIC CABLE EXERCIZER BAR

[76] Inventor: Robert S. Hinds, 1803 Regent St., Madison, Wis. 53705

[21] Appl. No.: 61,181

[22] Filed: Jul. 27, 1979

Related U.S. Application Data

[62] Division of Ser. No. 755,552, Dec. 30, 1976, Pat. No. 4,195,835.

[51] Int. Cl.[3] ..... A63B 21/02

[52] U.S. Cl. ..... 272/138

[58] Field of Search ..... 272/67, 68, 142, 134, 272/126, 137, 138, 125

[56] References Cited

U.S. PATENT DOCUMENTS

| | | | |
|---|---|---|---|
| 61,702 | 2/1867 | Barnett | 272/137 |
| 3,117,781 | 1/1964 | Vargo | 272/125 |
| 3,265,015 | 8/1966 | Alder | 105/378 |
| 3,740,033 | 6/1973 | Kamp | 272/68 X |
| 3,785,644 | 1/1974 | Bradley et al. | 272/140 |
| 3,910,573 | 10/1975 | Jamba | 272/125 |
| 4,059,265 | 11/1977 | Wieder et al. | 272/137 |

FOREIGN PATENT DOCUMENTS

| | | | |
|---|---|---|---|
| 304059 | 3/1955 | Switzerland | 272/137 |

*Primary Examiner*—Richard C. Pinkham
*Assistant Examiner*—William R. Browne
*Attorney, Agent, or Firm*—Keith Schoff

[57] ABSTRACT

In an elastic cable exerciser an improved bar is provided. The bar has a groove in its upper surface to receive the cable. The groove extends from one end to the other to provide a downward run of cable at each end of the bar. Finger-like projections at each end of the bar retain the cable so that the cable is wound up on the bar as the bar is rotated.

1 Claim, 16 Drawing Figures

Fig. 8.
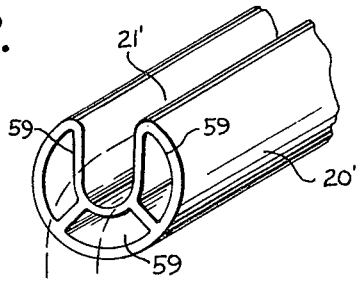
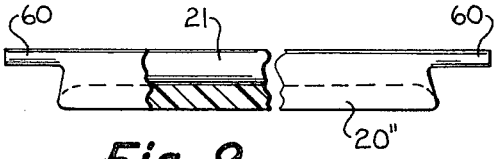
Fig. 9.
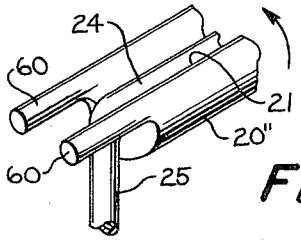
Fig. 10.
Fig. 11.
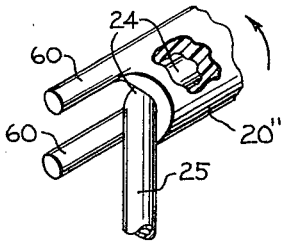
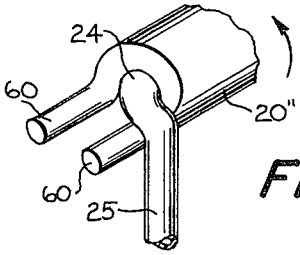
Fig. 12.
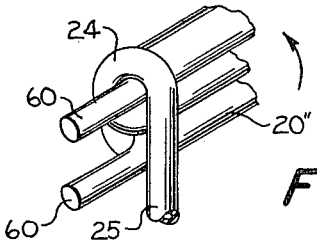
Fig. 13.
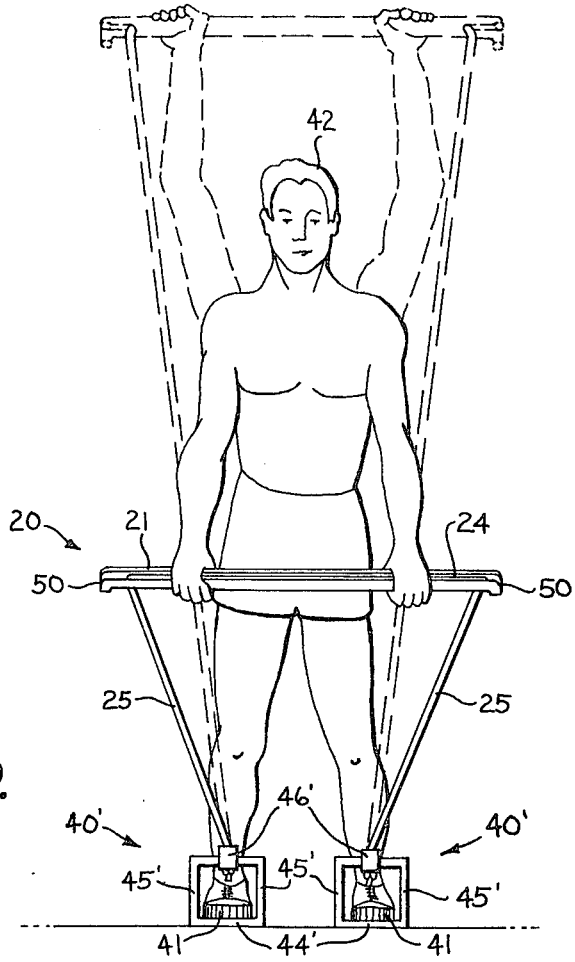
Fig. 14.
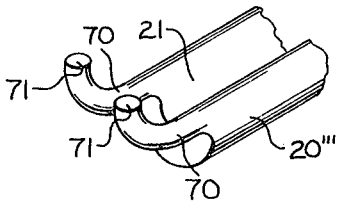
Fig. 15.
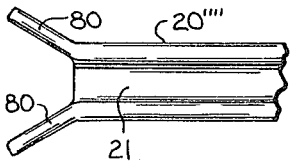
Fig. 16.

METHOD FOR USING ELASTIC CABLE EXERCIZER BAR

This application is a division of Ser. No. 755,552 filed Dec. 30, 1976, now U.S. Pat. No. 4,195,835.

CROSS-REFERENCES

The following cases relate to the same subject matter: Ser. No. 755,551 filed Dec. 30, 1976, entitled ELASTIC CABLE EXERCISER GRIP MEMBER, and Ser. No. 651,271 filed Jan. 22, 1976, entitled ELASTIC PULL TYPE EXERCISER.

FIELD

This invention relates to an exercising device comprising an elastic cable and more particularly to such a device comprising a bar which is generally held in a substantially horizontal position and is engaged with the cable.

PRIOR ART

An exercising device comprising an elastic cable is described in U.S. Pat. No. 61,702 issued in 1867 and a horizontal bar engaged with a cable is disclosed therein. However, only one run of cable attached to the bar at the center of the bar is provided.

Many similar devices in which a single run of elastic cable is attached to the center of a horizontal bar have been subsequently described. Later many patents have described devices comprising elastic cables in which a bar may be held horizontally with both hands of a user and a downward run of cable is provided at each end of the bar. An example is U.S. Pat. No. 3,265,015.

U.S. Pat. Nos. 3,117,781 and 3,785,644 show winding of a rope or cord at each end of a bar but the rope or cord is non-elastic.

No patent is known in which the structure of the bar herein described and claimed is disclosed. Particularly no patent is known which discloses a grooved bar as described herein or a bar with the herein described finger-like projections at each end.

SUMMARY

As part of an exercising device comprising an elastic cable, a bar is provided which may generally be held horizontally in both hands of the user and may engage with a cable to provide a downward run of the cable at each end of the bar. The bar is provided with a groove, extending from one end to the other, to receive the cable and finger-like projecting members are provided extending respectively from each side of the groove at each end of the bar to cause the cable to be retained in the groove when the bar is rotated through 180° and then to cause the cable to be wound on the bar as the bar is further rotated. The finger-like projecting members may extend directly longitudinally outward from the end of the bar or may extend divergently outward or may extend outwardly and thence downwardly (preferred) or extend outwardly and thence upwardly.

By suitably securing the cable at one end of the bar, the bar may be utilized to simulate the handle of a golf club, canoe paddle, hockey stick, tennis racket, baseball bat, or the like, and by making motions which simulate the use of such objects in the sports with which they are respectively associated, muscles used in these sports may be exercised.

OBJECTS

It is therefore an object of the invention to provide an improved bar in an elastic cable exercising device.

Another object is to provide such a bar which may be readily engaged and disengaged with the elastic cable used in such a device and which at the same time may be used in many exercises without disengagement of the cable from the bar.

Other objects will become apparent from the drawings and from the following detailed description in which it is intended to illustrate the applicability of the invention without thereby limiting its scope to less than that of all equivalents which will be apparent to one skilled in the art.

DRAWINGS

In the drawings like reference numerals refer to like parts and:

FIG. 8 is a perspective fragmentary view of one end of a bar which is a modification of the embodiment of FIGS. 1, 2, 3, 4 and 5;

FIG. 9 is a side elevation of a modification of the bar of FIG. 1;

FIG. 10 is a fragmentary perspective view of one end of the bar of FIG. 9 showing an elastic cable in conjunction therewith;

FIG. 11 is a view corresponding to that of FIG. 10 wherein the bar has been rotated through approximately 90°;

Figure 1:
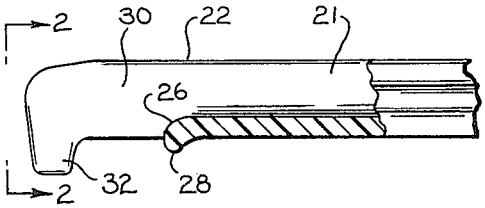
FIG. 1 is a partially cutaway elevation of a preferred embodiment of the bar in accordance with the invention.
Figure 1:
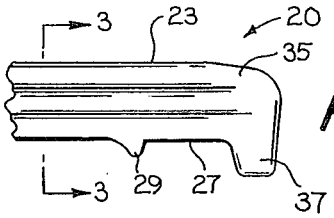

FIG. 12 is a view corresponding to that of FIGS. 10 and 11 wherein the bar has been rotated approximately 180° from the position shown in FIG. 10 and approximately 90° from the position shown in FIG. 11;

FIG. 13 is a view corresponding to that of FIGS. 10, 11 and 12 wherein the bar has been rotated approximately an additional 90° from the position shown in FIG. 12;

FIG. 14 is a front elevation of the bar being utilized in an exercise;

FIG. 15 is a fragmentary perspective view of one end of a bar which is a modification of the embodiment of FIG. 9 and also a modification of the embodiment of FIG. 1; and FIG. 16 is a fragmentary plan view of one end of a bar which constitutes a modification of the embodiment of FIG. 9.

DESCRIPTION

Reference is made herein to an elastic cable. It is understood that the term "elastic" may be accurately applied to a steel bar, a wooden board or in a broad sense nearly any solid object in referring to the tendency or ability of such object to return to its original position (when stress is released) after it has been strained by applying a stress to it.

However, the term is used herein throughout in the well known sense of referring to an object typified by a rubber band, a piece of shock cord or a length of surgical tubing which may consist of or comprise either a natural or synthetic elastomeric material, for example, natural rubber or a copolymer of butadiene and styrene. Objects referred to herein by use of the term "elastic" are characterized by returning to their original shape after having been deformed greatly. Thus, an "elastic" (as the term is used herein) cord or cable may be stretched to several times its original length by imposition of a suitable force and will return almost immediately to its original length when the force ceases to be imposed.

Figure 2:
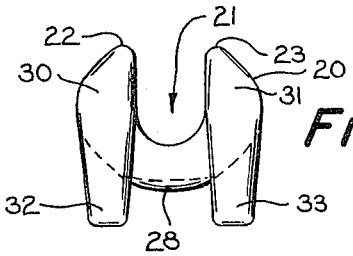
FIG. 2 is an end elevation taken on lines 2—2 in FIG. 1.
Figure 3:
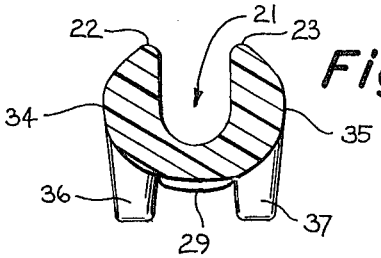
FIG. 3 is a cross-sectional view taken on lines 3—3 in FIG. 1.

Referring now to FIGS. 1, 2 and 3, bar 20 may be provided with groove 21 which may have two upper edges 22 and 23 which together may be said to constitute the upper surface of the bar so that groove 21 may be said to be a groove in the upper surface of the bar. Elastic cable 24 (FIGS. 4, 5 and 14) may be received in groove 21 to provide a downward run of cable from each end of the bar as indicated at 25. These runs may come into contact with the bar at points 26 and 27 at the respective ends of groove 21, adjacent respective ends of the bar. Downwardly extending projections 28 and 29 may be provided at the ends of groove 22 at points 26 and 27 to provide relatively generally rounded extended surfaces over which the cable may pass at each end of groove 21 rather than passing over a relatively sharp edge. At one end of bar 20 there may be provided a first pair of finger-like members adjacent point 26 which may extend longitudinally outward on each side of groove 21 as indicated at 30 and 31 and thence may extend downwardly as indicated at 32 and 33 and at the other end of the bar adjacent point 27 a like pair of finger-like members may be provided which may extend longitudinally outward on each side of the groove as indicated at 34 and 35 and thence may extend downwardly as indicated at 36 and 37.

Figure 4:
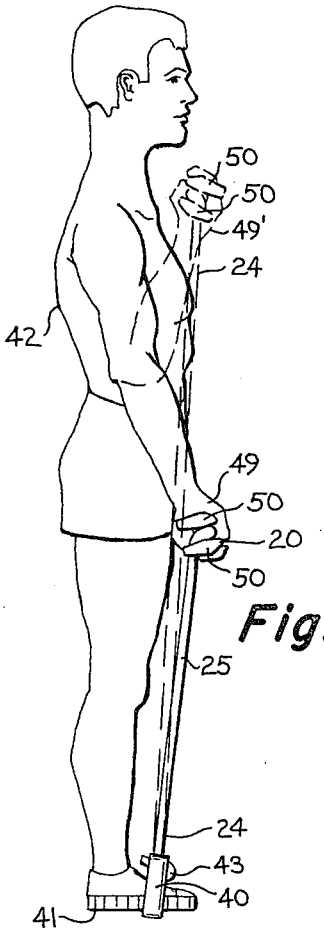
FIG. 4 is a side elevation of the bar being utilized in an exercise.

Referring now to FIG. 4, foot engaging members 40 which may also be used as hand grip members are shown engaged with the feet 41 of a user 42 and have the ends of cable 24 attached thereto at 43.

Figure 6:
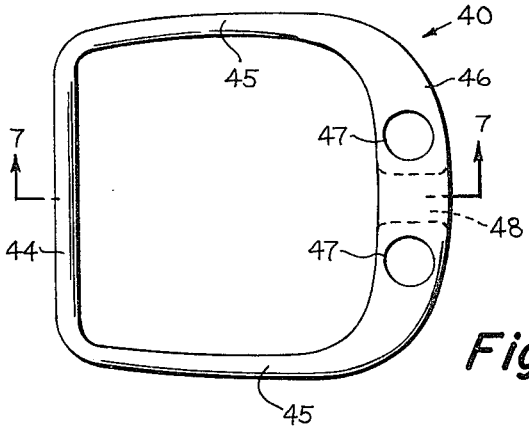
FIG. 6 is a plan view of a grip member which may be engaged with a foot as shown in FIG. 4.
Figure 7:
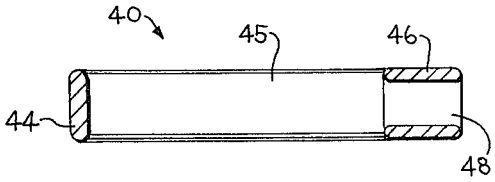
FIG. 7 is a cross-sectional view taken on lines 7—7 in FIG. 6.

An embodiment of member 40 (as shown in greater detail in FIGS. 6 and 7) may comprise a laterally extending "tread" portion 44 which may have two side portions 45 extending upwardly therefrom to a cable-attachment portion 46. Portion 46 may have holes 47 laterally received therein and hole 48 longitudinally received therein, in perpendicular relation to tread portion 44. Cable 24 may be attached thereto by first passing the cable through any one of the three holes and thence through any other but is preferably attached by first passing it through hole 48 and thence through one of holes 47 as indicated at 43 in FIG. 4. Security of attachment may be increased by passing the free end of the cable (after passing it through one of holes 47) under the bight then formed between hole 48 and that one of holes 47 through which it has been passed.

In FIG. 14, feet 41 of user 42 may be engaged with modifications 40' of members 40. Members 40' may be square in form as shown, having relatively straight side portions 45' integrally attached to cable-attachment portions 46' and relatively straight tread portions 44'.

Run 25 of a cable extending downwardly from an end of bar 20 may thus be effectively attached to one of feet 41 of user 42 as shown in FIGS. 4 and 14. When the user's hands are in the position shown in full lines in FIG. 4 (at 49) or in FIG. 14 the bar is tilted as shown and cable 24 instead of slipping loose from one end or the other or both ends of groove 21 as it might otherwise do is caught behind one of finger-like members 50. Finger-like members 50, as shown, may be either the finger-like members comprising portions 30, 31, 32 and 33 or the finger-like members comprising portions 34, 35, 36 and 37.

When user 42's arms are lifted to a position such as shown in dashed lines in FIG. 4 (at 49') or in FIG. 14, the bar as may be seen is tilted in the opposite direction so that cable 24 is caught by the other one of finger-like members 50.

Figure 5:
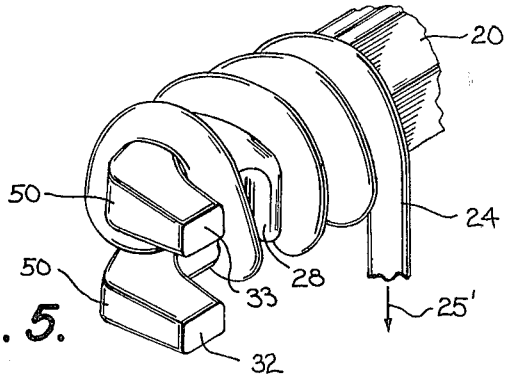
FIG. 5 is a fragmentary perspective view of one end of the bar showing an elastic cable received in the groove of the bar and wound therearound in response to rotation of the bar.

The effective length of each of runs 25 of cable 24 may be reduced by further rotating the bar so that cable 24 having been caught behind one of finger-like members 50 is wound several times around the end of bar 20 as shown for one end of the bar in FIG. 5, the run of the cable from one end of the bar being indicated in this instance by the arrow 25'.

Referring now to FIG. 8 there is shown an embodiment wherein bar 20' is an extruded member of aluminum or polymeric synthetic resinous material having three hollow portions 59 and a groove 21' which is let into the upper surface of bar 20' but differs from groove 21 in that it does not have rounded ends as at points 26 and 27 in FIG. 1.

Referring now to FIG. 9 there is shown an embodiment wherein bar 20'' is provided with a groove 21 which may be identical with groove 21 of the embodiment of FIG. 1. Extending from each end of the bar alongside the edges of the groove there may be provided finger-like members 60 which differ from members 50 in that they extend straight out longitudinally and are neither turned down nor turned up at the ends.

Referring now to FIG. 10, bar 20'' is shown in a position in which groove 21 opens upwardly, cable 24 being received in the groove and a run of cable 25 being extended downwardly from the end of the bar as shown. When bar 20'' is rotated as shown in FIG. 11, cable 24 is caught by the lowermost of finger-like members 60 and thus prevented from coming out of groove 21.

When bar 20'' is rotated still further as shown in FIG. 12, the effect of the aforementioned one of finger-like members 50 has become more pronounced in its action in retaining cable 24 in attached relationship to the bar and within groove 21.

When bar 20'' is rotated still further as shown in FIG. 13, the manner in which cable 24 continues to be retained within groove 21 and thereby in attached relationship to the bar is more clearly shown. Also shown in FIG. 13 is the manner in which cable 24 thus begins to be wound around the bar whereby, by continued rotation of the bar, several windings of the cable around the bar can be provided as shown in FIG. 5.

Referring now to FIG. 15, it may be seen that bar 20''' may be provided having a groove 21 corresponding to grooves 21 previously described and having finger-like members 70 which extend longitudinally outward on each side of the groove at each end of the bar (only one end being shown) and then instead of extending downwardly as described for the bar of FIGS. 1 to 5 instead extend upwardly as indicated at 71. Finger-like members 70 function in the same manner as described hereinbefore for finger-like members 50 and 60.

Referring now to FIG. 16, bar 20'''' may be provided with a groove 21 which may be identical to groove 21 described in connection with previous embodiments and may be provided with finger-like members 80 extending outward from each end, only one end being shown, respectively alongside each side of groove 21. Finger-like members 80 may however extend divergently longitudinally outward instead of extending parallelly longitudinally outward as described for finger-like members 60. Finger-like members 80 are shown as being turned neither upwardly nor downwardly near their ends but if desired they could be turned either upwardly as described for finger-like members 70 or downwardly as described for finger-like members 50.

It will be apparent to those skilled in the art that equivalents may be utilized.

Accordingly, the present invention may be embodied in other specific forms without departing from the spirit or essential attributes thereof and accordingly reference should be made to the appended claims rather than to the foregoing specification as indicating the scope of the invention.

It is claimed:

1. The method of tensioning a bight of elastomeric cable which depends in recessed disposition from between bifurcated projections configured as end extremities of a bar elevated above fixedly held ends of said tensioned cable comprising the step of rotating said bar until said cable is wrapped around at least one of said bifurcated end extremities and whereupon with continued rotation said cable is at least partially wound around said bar.

* * * * *